United States Patent [19]

Rinke

[11] Patent Number: 4,848,515

[45] Date of Patent: Jul. 18, 1989

[54] PORTABLE SWIMMING POOL STEP DEVICE

[75] Inventor: Robert M. Rinke, Fargo, N. Dak.

[73] Assignee: Sure-Step, Inc., Fargo, N. Dak.

[21] Appl. No.: 262,577

[22] Filed: Oct. 26, 1988

[51] Int. Cl.[4] ..... E06C 1/383; E06C 1/397

[52] U.S. Cl. ..... 182/20; 182/106; 182/163; 182/46

[58] Field of Search ..... 182/163, 24, 106, 20, 182/21, 49, 1, 46

[56] References Cited

U.S. PATENT DOCUMENTS

| | | | |
|---|---|---|---|
| 1,936,508 | 11/1933 | Hanly | 182/24 |
| 2,551,345 | 5/1951 | Scott | 182/106 |
| 2,864,542 | 12/1958 | Marryatt | 182/21 |
| 2,907,402 | 10/1959 | Lewis | 182/106 |
| 3,083,784 | 4/1963 | Urian | 182/163 |

*Primary Examiner*—Reinaldo P. Machado
*Attorney, Agent, or Firm*—Herman H. Bains

[57] ABSTRACT

A portable, foldable swimming pool step device includes a pair of sectional stiles interconnected by transverse steps and provided with sectional handrail structures. The stiles, steps, and handrail structures are formed of a thermoplastic material. Each stile includes a pair of sections hingedly connected together and foldable between an extended operative position and a folded position. The steps are adjustable to permit the swimming pool step device to function as an inclined ramp. Suitable rollers are mounted on the stiles to permit easy movement of the swimming pool step device when the ladder is in the folded position.

7 Claims, 2 Drawing Sheets

PORTABLE SWIMMING POOL STEP DEVICE

This invention relates to a portable swimming pool step device and, more particularly, to a foldable portable swimming pool step device.

BACKGROUND OF THE INVENTION

Most swimming pools, especially institutional swimming pools, are usually provided with steps or ladders to facilitate entry into or exit from the pool. However, some people, especially handicapped people, find these conventional steps and ladders difficult to negotiate. Although some attempts have been made provide accessory steps for institutional pools, these prior art accessory steps are heavy, bulky, and sometimes unsafe for handicapped persons.

SUMMARY OF THE INVENTION

It is an object of this invention to provide a lightweight, foldable, portable swimming pool step device, of simple and inexpensive construction, which has a special utility for providing easy and safe access to and from a swimming pool by handicapped persons. It is also pointed out that this novel swimming pool step device is also useable as the primary means for anyone entering or exiting from a swimming pool.

It is a further object of this invention to provide a portable swimming pool step device comprised of a pair of foldable stiles having steps extending therebetween and adjustably connected thereto and having handrail structures detachably mounted thereon.

The entire swimming pool step device is formed of a lightweight strong plastic material, preferably of a thermoplastic, so that the entire device is of a lightweight construction, while having high strength characteristics. The swimming pool step device includes a pair of stiles, each including a pair of sections, which are hingedly connected together to permit the step structure to be folded into a collapsed position for easy portability. The steps, which interconnect the stiles, are adjustable to provide the safest angle of descent for a user. The detachable molded handrails have a generally circular, but grooved, cross-sectional configuration, which minimizes the occurrence of slippage by a user gripping the handrails. Rollers are secured to the stiles to facilitate movement of the swimming pool step device when the ladder is in the collapsed folded position.

These and other objects will be more fully defined in the following Specification.

FIGURES OF THE DRAWING

DESCRIPTION OF THE PREFERRED EMBODIMENT

Figure 1:
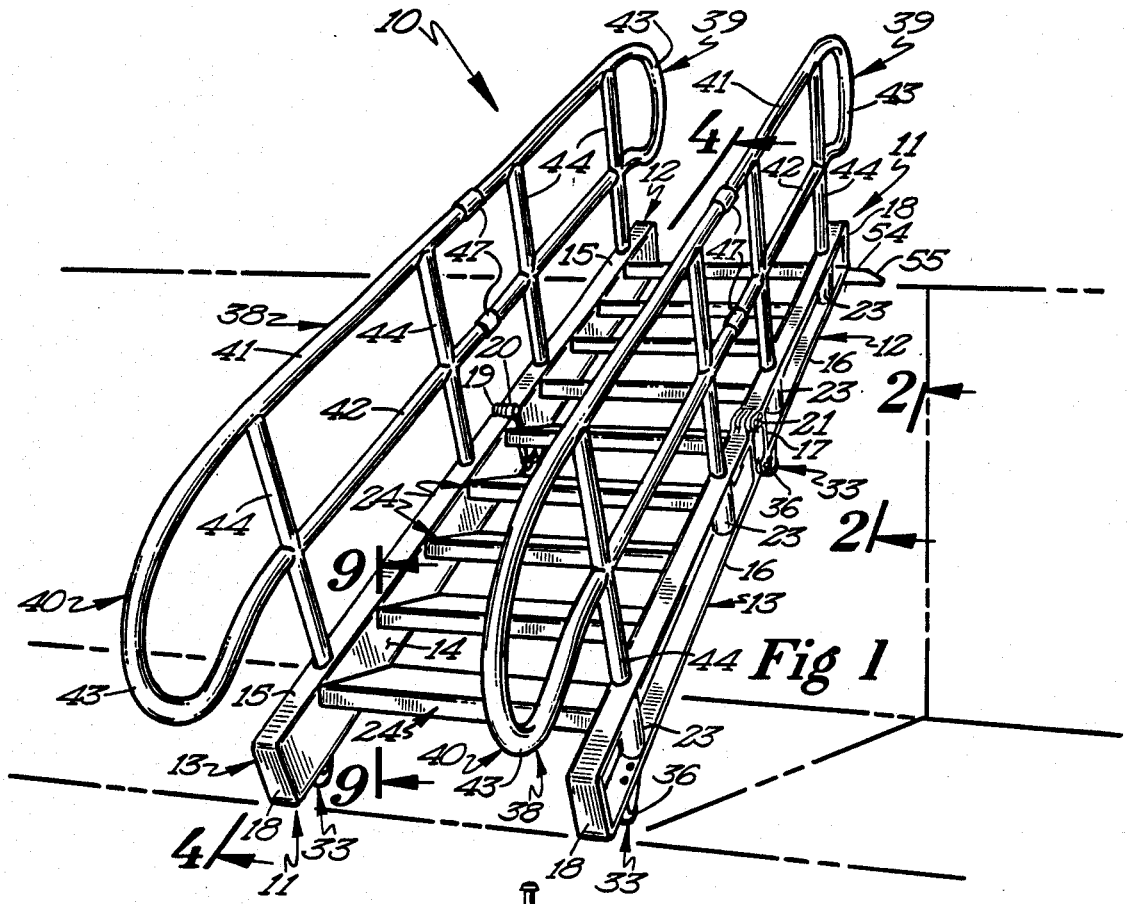
FIG. 1 is a perspective view of the novel swimming pool step device.

Referring now to the drawings and, more specifically, to FIG. 1, it will be seen that one embodiment of the portable swimming pool step device, designated generally by the reference numeral 10, is thereshown. The swimming pool step device 10 is comprised of a pair of substantially identical stiles 11, each including an elongate generally channel-shaped upper stile section 12 and an elongate generally channel-shaped lower stile section 13. It will be noted that, when the swimming pool step device is in the erect position, the upper and lower stile sections for each stile are disposed in substantially end-to-end alignment. It is also pointed out that the stile sections are of substantially identical construction, and each is formed of a structural plastic material, preferably of a thermoplastic, which is of lightweight, high strength construction.

Each stile section includes a substantially flat web 14 having an upper flange 15 and a lower flange 16 integrally formed therewith and extending outwardly therefrom. It will also be noted that each stile section also includes an upper end wall 17 and a lower end wall 18.

Figure 3:
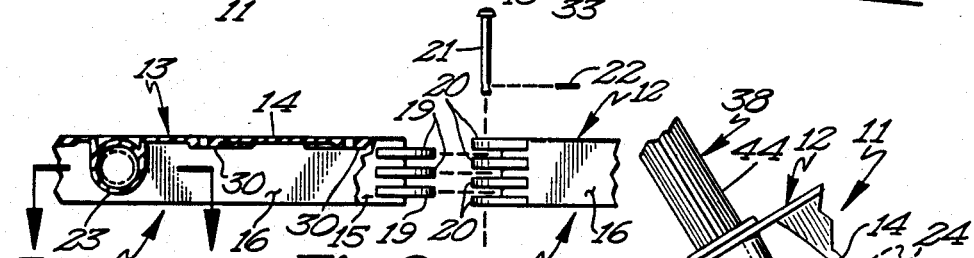
FIG. 3 is a fragmentary view taken approximately along line 3—3 of FIG. 2 and looking in the direction of the arrows, with certain parts thereof broken away for clarity.
Figure 2:
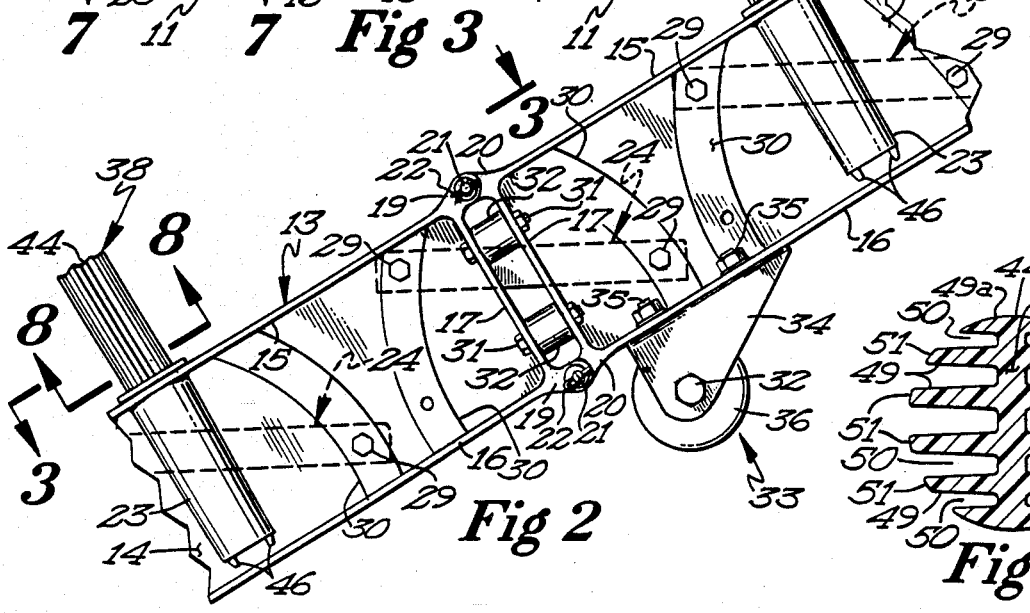
FIG. 2 is a fragmentary side view of a portion of the swimming pool step device taken approximately along the line 2—2 of FIG. 1 and looking in the direction of the arrows.
Figures 4, 5, 6, 7, 9:
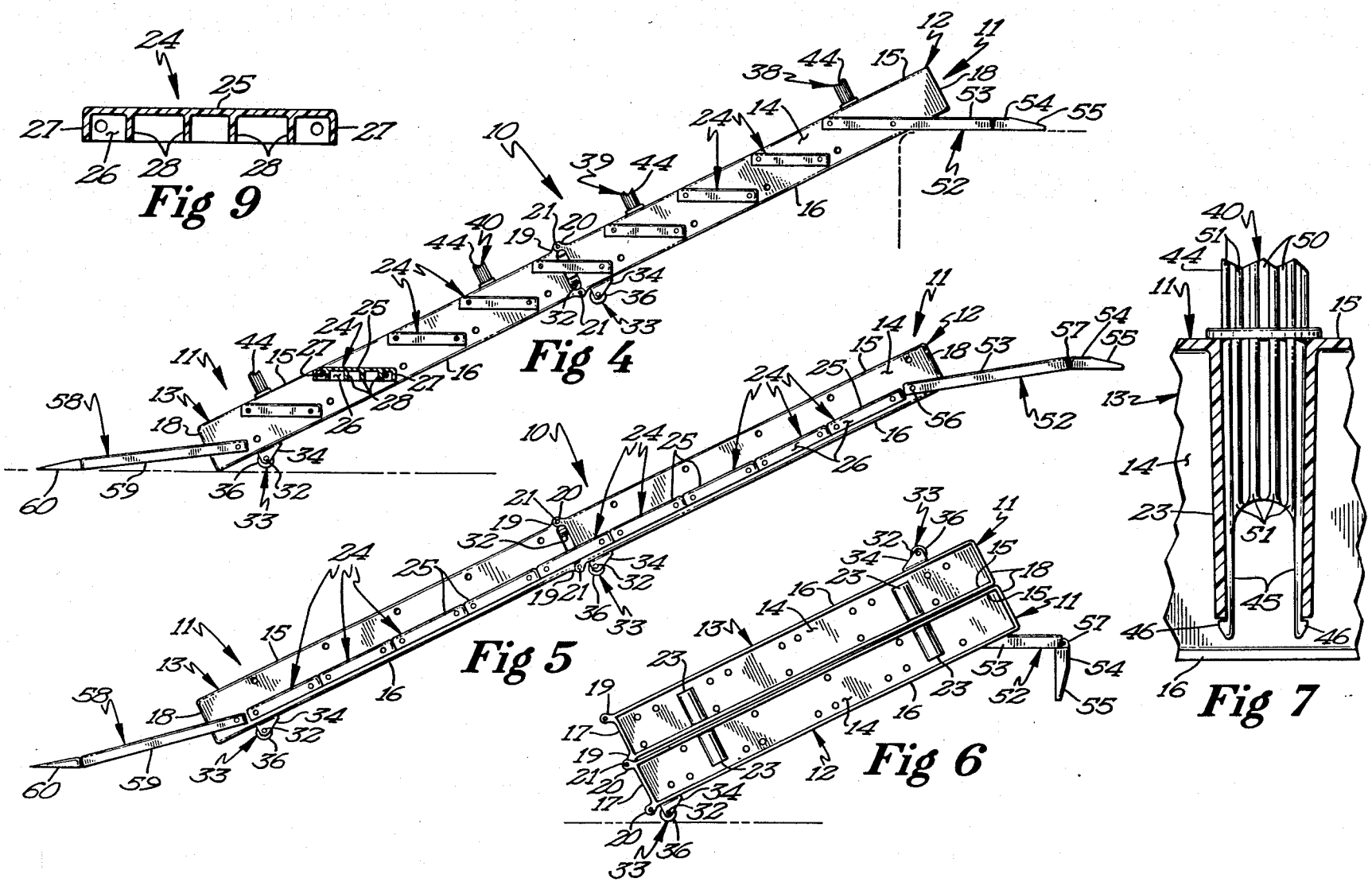
FIG. 4 is a cross-sectional view taken approximately along line 4—4 of FIG. 1 and looking in the direction of the arrows.
FIG. 5 is a cross-sectional view similar to FIG. 4, but illustrating the step of the swimming pool step device in a different position.
FIG. 6 is a side elevational view of the swimming pool step device, illustrating the same in a folded or collapsed position.
FIG. 7 is a cross-sectional view of a handrail post and socket of the swimming pool step device, illustrating details of construction thereof.
FIG. 9 is an enlarged cross-sectional view of one of the steps, illustrating details of construction thereof.

The upper and lower stile sections for each stile are hingedly connected together for movement between an extended position, as illustrated in FIG. 1, and a folded or collapsed position, as illustrated in FIG. 6. This hinge means includes a plurality of similar apertured hinge elements 19, which are integrally formed with the stile sections and project longitudinally therefrom, as best seen in FIGS. 2 and 3. In this regard, the hinge elements 19 for the upper stile section of each stile are integrally formed with the lower end thereof and project longitudinally therefrom, while the hinge elements on each lower stile section are integrally formed with the upper end thereof and project longitudinally therefrom.

In the embodiment shown, the upper stile section for each stile has four hinge elements integrally formed therewith, while each lower stile section is provided with three such hinge elements. It will further be noted that each stile section has an upper group of hinge elements, which project from the upper portion thereof, and a lower group of hinge elements, which project from the lower portion thereof. Finally, it will be noted that the hinge elements are disposed in interdigitating relation so that the apertures therein are disposed in registering relation and permit the insertion of a hinge pin 21 therethrough. A suitable retainer in the form of a cotter pin is provided for releasably locking the hinge pin to the hinge elements.

Referring again to FIGS. 2 and 3, it will be seen that each stile section is also provided with a molded-in upwardly opening cylindrical socket 23, which is integrally formed with the web 14 of each stile section, and which tapers slightly in a downward direction.

The stiles 11 are interconnected by transversely extending steps 24, which are of generally rectangular configuration. Referring now to FIGS. 2, 4, and 9, it will be seen that each of the steps 24 has a substantially flat upper surface 25 having downturned end flanges 26, which are disposed in engaging relation with the webs 14 of the stile sections. Each step 24 also is provided with transverse flanges 27 and reinforcing transversely extending ribs 30 that are integral with the lower surface of each step and depend therefrom.

The steps are secured to the stile sections by suitable bolts 29. In this regard, it will be noted that the webs 14 of the stile sections are provided with arcuate reinforcing ribs 30 through which the bolts 29 extend. It will further be noted that the steps 24 may be adjusted by repositioning the bolts in the step from the position illustrated in FIGS. 2 and 4 to the position illustrated in FIG. 5. In this regard, the steps 24 will be disposed in end-to-end relation, thereby defining an inclined platform, rather than the shallow-angled steps of FIG. 4. It is pointed out that the angle defined by the stiles and the bottom of the swimming pool is within the range of 24 to 30 degrees, although it is preferred that the angle be approximately 27 degrees.

It will be noted that certain steps 24 interconnect the upper stile sections together and that other steps interconnect the lower stile sections together. Therefore, the upper stile sections 12 interconnecting steps 24 define an upper step section, and the lower stile sections 13 interconnecting steps 24 define a lower step section.

Referring again to FIG. 2, it will be seen that, when the swimming pool step device is in the extended position, nut and bolt assemblies 31 interconnect the longitudinally aligned stile sections together. Suitable cylindrical spacers 32 are positioned between the adjacent lower end wall 18 of the upper stile section and the upper end wall 17 of the lower stile section. It will further be noted that the lower end portion of each stile section is provided with a roller assembly 33 to facilitate movement of the swimming pool step device in the folded position. Each roller assembly 33 includes a channel-shaped roller bracket 34, which is rigidly secured to the lower flange 16 of the associated stile section by nut and bolt assemblies 35. Each roller assembly includes a roller 36, which is journaled on an end or axle 37 in a conventional manner.

The swimming pool step device 10 also includes a pair of substantially identical sectional rail structures 38, each being detachably secured to one of the stiles 11 and projecting upwardly therefrom. It is again pointed out that the rail structures are formed of a plastic material, preferably of a thermoplastic, in a molding operation. Each sectional rail structure includes an upper rail section 39 and a lower rail section 40. It will be seen that each upper rail section is detachably secured to an upper stile section, and each lower rail section is secured to a lower stile section.

Each section is of substantially identical construction, and each includes an elongate substantially straight horizontal upper rail element 41 and a horizontal lower rail element 42, which are disposed substantially parallel thereto. The upper and lower rail elements of each rail section are integral with the curved end portion 43, as best seen in FIG. 1. Each rail section also includes a pair of spaced apart vertical posts 44, which are disposed in substantially parallel relation with each other, and which extend between and are rigidly integral with the associated upper and lower rail elements 41 and 42, respectively.

Each vertical post 44 has a recess in the lower end portion thereof to define a pair of socket engaging elements 45, each having a retaining element 46 integral with the lower end thereof and projecting outwardly therefrom. The posts 44 have their lower end portions thereof inserted into the sockets 23 until the socket engaging elements 45 project therethrough to permit the retaining elements 46 to engage the lower edge of the tapered sockets. This releasably locks the posts 44 and the rail sections to the stile sections. The upper and lower rail sections for each rail structure are interconnected together by suitable connector sleeves 47, as best seen in FIG. 1. The connector sleeves are also formed of plastic material.

Figure 8:
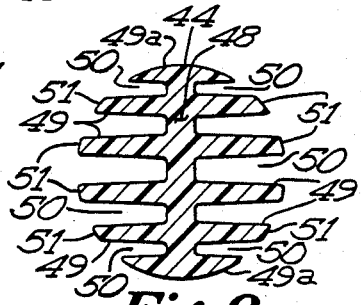
FIG. 8 is a cross-sectional view taken approximately along line 8—8 of FIG. 2 and looking in the direction of the arrows.

Another important feature of the novel swimming pool step device is the specific molded construction of the components of the rail structure itself. Referring now to FIG. 8, it will be seen that the cross-sectional construction of the rail structure shows its unique configuration. Each component of the rail structure includes a central web 48 having ribs 49 integral therewith and projecting outwardly from opposite sides thereof. Adjacent ribs 49 are spaced apart to define grooves 50 therebetween, which each extend from the outer ends of the ribs to the central web 48. The ribs **49*a*, located at the ends of the web, have a curved outer surface, while the outer ends of the intermediate ribs 49 are curved, as at 51**. It will, therefore, be seen that the general configuration of the rail components is circular and is defined by the rib groove construction. This particular construction substantially improves the grip ability of the rails and provides an extremely strong, but lightweight, structure.

The swimming pool step device also is provided with an upper platform 52, which includes a main platform section 53 pivotally connected to a ramp platform section 54. The upper surface of the main platform section 53 is flat, while the upper surface of the ramp section 54 is inclined downwardly from the main section, as at 55. The main platform section 53 is pivotally connected to the upper stile sections 12 by means of a pivot 56. The ramp section 54 is pivotally connected to the main section by a pivot 57. In this regard, it is pointed out that the main section and the ramp section of the upper platform are provided with apertured interdigitated hinge elements of the same construction as the interdigitating hinge elements which pivotally interconnect the stile sections. The inclined ramp portion facilitates easy access by a handicapped person to the swimming pool steps.

The swimming pool step device is also provided with a lower platform 50, which is also comprised of a main platform section 59 and a generally wedge-shaped ramp platform section 60. The main platform section 59 is pivotally connected to the lower stile sections by a pivot 61, while the ramp section 60 is pivotally connected to the main platform section 59 by a pivot 62. The specific pivot or hinge connection between the main platform section 59 and the ramp section 60 is substantially identical to that for the upper platform 52.

In use, the novel swimming pool step device will be assembled and will be placed in a swimming pool in the position illustrated in FIGS. 1 and 4. The steps 24 will have been secured to the stile sections so that the steps are disposed at the angle illustrated in FIG. 4. It is again pointed out that, while the steps 24 are disposed in substantially parallel relation with respect to the pool bottom, the general angle of inclination of the swimming pool step device is within the range of 24 to 30 degrees. The stiles will be resting on the wall of the swimming pool and the pool bottom, while the upper platform will engage the upper floor surface adjacent the swimming pool.

However, in some instances it may be desirable to adjust the swimming pool steps so that a ramp is defined. This is done by repositioning the bolts 29 and shifting each of the steps to the position illustrated in FIG. 5. The steps 24 will be disposed in end-to-end relation with respect to each other to thereby define an inclined ramp. The upper and lower platforms will be adjusted to engage the upper floor surface adjacent the swimming pool and the swimming pool bottom in the manner desired.

When it is desirable to remove and store the swimming pool step device, the user will remove the sectional rail structures 38 from their connected relation with the stile sections. In this regard, the socket engaging elements 45 will be urged inwardly to permit the retaining elements to clear the lower edge of the tapered sockets 23, and the post will be removed from the sockets. Thereafter, the connector sleeves 47 will be disconnected, thereby allowing the rail structures to be completely disassembled.

Thereafter, the bolt assemblies 31 and spacers 32 will be removed from the stile sections. Finally, one of the hinge pins 21 between each upper and lower stile section will be removed to thereby permit the stile sections to be folded upon themselves in the manner illustrated in FIG. 6. The upper and lower platforms may be removed or may be pivoted to an out of the way position. The user may then roll the swimming pool step device to a convenient storage location where the swimming pool step device may be stored. The capability of being able to remove the rail structure and being able to fold the stiles upon themselves provides a collapsed structure of relatively small compass, which facilitates storage and handling of the swimming pool step device.

From the foregoing description, it will be seen that I have provided a novel swimming pool step device, which is not only of simple and inexpensive construction, but one which has special utility for handicapped persons and the like.

What is claimed is:

1. A portable, foldable swimming pool step device comprising:

a pair of substantially similar, elongate stiles, each being formed of a rigid plastic material, and each including an elongate upper section and an elongate lower section disposed in longitudinal alignment with said upper section, means hingedly connecting said upper and lower sections of each stile together and permitting folding of each section upon the other section, means interconnecting the upper and lower sections of each stile together for retaining the sections in longitudinally aligned relation, each stile section having a plurality of vertical sockets therein, a plurality of roller devices, each being connected to one end of one of each of said stile sections to facilitate movement of said swimming pool step device when the ladder is in the folded condition, a plurality of substantially identical steps extending between said stile sections, means securing said steps to said stile sections and permitting each step to be angularly adjusted relative to the stile sections, and a pair of handrail structures formed of plastic and each including horizontal handrail elements and vertical handrail posts, each of said vertical handrail posts of each handrail structure projecting into a socket of said stile section to detachably secure each handrail structure to one of said stiles.

2. The swimming pool step device as defined in claim 1 wherein said steps, when in one adjusted position, are vertically spaced apart and are disposed in substantially parallel relation with respect to each other, and, when in the other adjusted position adjacent steps are disposed in end-to-end relation to thereby define a substantially planar inclined ramp.

3. The swimming pool step device as defined in claim 1 and an upper sectional platform including a substantially flat main platform section pivotally connected to the upper stile section, and a ramp platform section pivotally connected to said main platform section and having an inclined upper surface.

4. The swimming pool step device as defined in claim 1 wherein each of said handrail structures is of sectional construction and includes an upper handrail section and a lower handrail section, and cylindrical connector means detachably connecting the horizontal handrail elements of the upper handrail section to the horizontal handrail elements of the associated lower handrail section to thereby permit ready assembly and disassembly of each of said handrail structures.

5. The swimming pool step device as defined in claim 1 wherein each of said sockets of said stile section taper slightly from the upper end thereof to the lower end thereof, and each of said vertical handrail posts have a pair of socket engaging elements integrally formed therewith and projecting through one of said sockets, means on the lower ends of said socket engaging elements engaging the lower end of each socket to releasably retain each handrail post therein.

6. The swimming pool step device as defined in claim 1 wherein each of said handrail elements and vertical posts includes a central web having a plurality of spaced apart ribs integrally formed therewith and extending outwardly therefrom to define grooves between adjacent ribs.

7. The swimming pool step device as defined in claim 1 and a lower sectional platform including a substantially flat main platform section pivotally connected to the lower stile sections, and a ramp platform section pivotally connected to said lower main platform section.

* * * * *